US008307809B2

(12) United States Patent
Hay et al.

(10) Patent No.: US 8,307,809 B2
(45) Date of Patent: Nov. 13, 2012

(54) ENGINE ASSEMBLY INCLUDING CAM COVER MOUNTED FUEL RAIL

(75) Inventors: James D. Hay, Milford, MI (US); Joel Cowgill, White Lake, MI (US); Rodney E. Baker, Fenton, MI (US)

(73) Assignee: GM Global Technology Operations LLC

( * ) Notice: Subject to any disclaimer, the term of this patent is extended or adjusted under 35 U.S.C. 154(b) by 363 days.

(21) Appl. No.: 12/689,463

(22) Filed: Jan. 19, 2010

(65) Prior Publication Data

US 2011/0073074 A1 Mar. 31, 2011

Related U.S. Application Data

(60) Provisional application No. 61/246,632, filed on Sep. 29, 2009.

(51) Int. Cl.
*F02M 55/02* (2006.01)

(52) U.S. Cl. ..... 123/469; 123/468; 123/198 E

(58) Field of Classification Search ..... 123/456, 123/468, 469, 470, 198 E
See application file for complete search history.

(56) References Cited

U.S. PATENT DOCUMENTS

| | | | | | |
|---|---|---|---|---|---|
| 4,286,777 | A * | 9/1981 | Brown | 267/294 |
| 4,306,708 | A * | 12/1981 | Gassaway et al. | 267/141.3 |
| 4,384,557 | A * | 5/1983 | Johnson | 123/198 D |
| 4,445,713 | A * | 5/1984 | Bruning | 285/14 |
| 5,044,338 | A * | 9/1991 | Shelton | 123/469 |
| 5,172,671 | A * | 12/1992 | Peters et al. | 123/470 |
| 5,511,520 | A * | 4/1996 | Regueiro | 123/193.5 |
| 5,529,038 | A * | 6/1996 | Tsuchida | 123/305 |
| 5,564,395 | A * | 10/1996 | Moser et al. | 123/509 |
| 5,682,857 | A * | 11/1997 | Briggs et al. | 123/456 |
| 5,697,344 | A * | 12/1997 | Ikari | 123/468 |
| 5,699,770 | A * | 12/1997 | Matsumoto et al. | 123/470 |
| 6,340,019 | B1 * | 1/2002 | Eshleman et al. | 123/469 |
| 6,394,071 | B2 * | 5/2002 | Nitta et al. | 123/456 |
| 6,513,499 | B2 * | 2/2003 | Kehoe | 123/456 |
| 7,316,215 | B1 * | 1/2008 | Nino et al. | 123/90.38 |
| 7,347,187 | B2 * | 3/2008 | Perini | 123/456 |
| 7,398,766 | B2 * | 7/2008 | Liskow | 123/469 |
| 7,415,968 | B1 * | 8/2008 | Matas et al. | 123/456 |
| 7,591,246 | B2 * | 9/2009 | Beardmore et al. | 123/456 |
| 7,682,117 | B2 * | 3/2010 | Holt et al. | 411/156 |
| 7,712,452 | B2 * | 5/2010 | Matas et al. | 123/456 |
| 8,091,533 | B2 * | 1/2012 | Ng et al. | 123/456 |

FOREIGN PATENT DOCUMENTS

| | | | |
|---|---|---|---|
| CN | 101004159 | A | 7/2007 |
| DE | 602004000933 | T2 | 12/2006 |
| DE | 102007002076 | A1 | 8/2007 |
| DE | 102007036500 | A1 | 2/2009 |
| EP | 1460264 | A1 | 9/2004 |
| JP | 11022592 | A | 1/1999 |

* cited by examiner

*Primary Examiner* — Thomas Moulis
(74) *Attorney, Agent, or Firm* — Harness, Dickey & Pierce, P.L.C.

(57) ABSTRACT

An engine assembly may include a cylinder head, a cam cover and a fuel rail assembly. The cylinder head may define intake and exhaust ports and the cam cover may be fixed to the cylinder head. The fuel rail assembly may include a fuel rail, a bracket assembly and a fuel injector. The bracket assembly may be fixed to the fuel rail and may include a fastener and an isolation member. The fastener may be engaged with the cam cover and may secure the fuel rail thereto. The isolation member may be located between the fuel rail and the cam cover to isolate vibration therebetween. The fuel injector may be in communication with the fuel rail and may extend into a combustion chamber defined by the cylinder head at a location between the intake and exhaust ports.

20 Claims, 5 Drawing Sheets

ENGINE ASSEMBLY INCLUDING CAM COVER MOUNTED FUEL RAIL

CROSS-REFERENCE TO RELATED APPLICATIONS

This application claims the benefit of U.S. Provisional Application No. 61/246,632, filed on Sep. 29, 2009. The entire disclosure of the above application is incorporated herein by reference.

FIELD

The present disclosure relates to engine fuel rails, and more specifically to engine fuel rail mounting.

BACKGROUND

This section provides background information related to the present disclosure which is not necessarily prior art.

Engine assemblies may include central direct fuel injection arrangements where fuel injectors extend into the combustion chamber at a central region. However, in smaller engines the fuel rail may not fit within a central region of a cylinder head due to other components occupying the space, such as spark plug assemblies. In these arrangements, the fuel rail may be mounted to a side of the cylinder head and long fuel lines may extend between the fuel rail and the fuel injectors. The location of the fuel rail and mounting arrangement may result in excessive stresses on the fuel lines resulting from vibration and hydraulic load.

SUMMARY

This section provides a general summary of the disclosure, and is not a comprehensive disclosure of its full scope or all of its features.

An engine assembly may include a cylinder head, a cam cover and a fuel rail assembly. The cylinder head may define intake and exhaust ports and the cam cover may be fixed to the cylinder head. The fuel rail assembly may include a fuel rail, a bracket assembly and a fuel injector. The bracket assembly may be fixed to the fuel rail and may include a fastener and an isolation member. The fastener may be engaged with the cam cover and may secure the fuel rail thereto. The isolation member may be located between the fuel rail and the cam cover to isolate vibration therebetween. The fuel injector may be in communication with the fuel rail and may extend into a combustion chamber defined by the cylinder head at a location between the intake and exhaust ports.

In one arrangement, the isolation member may be located axially on the fastener between the bracket and the cam cover. In another arrangement, the isolation member may be located between the bracket and the fuel rail.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only and are not intended to limit the scope of the present disclosure in any way.

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

Figure 1:
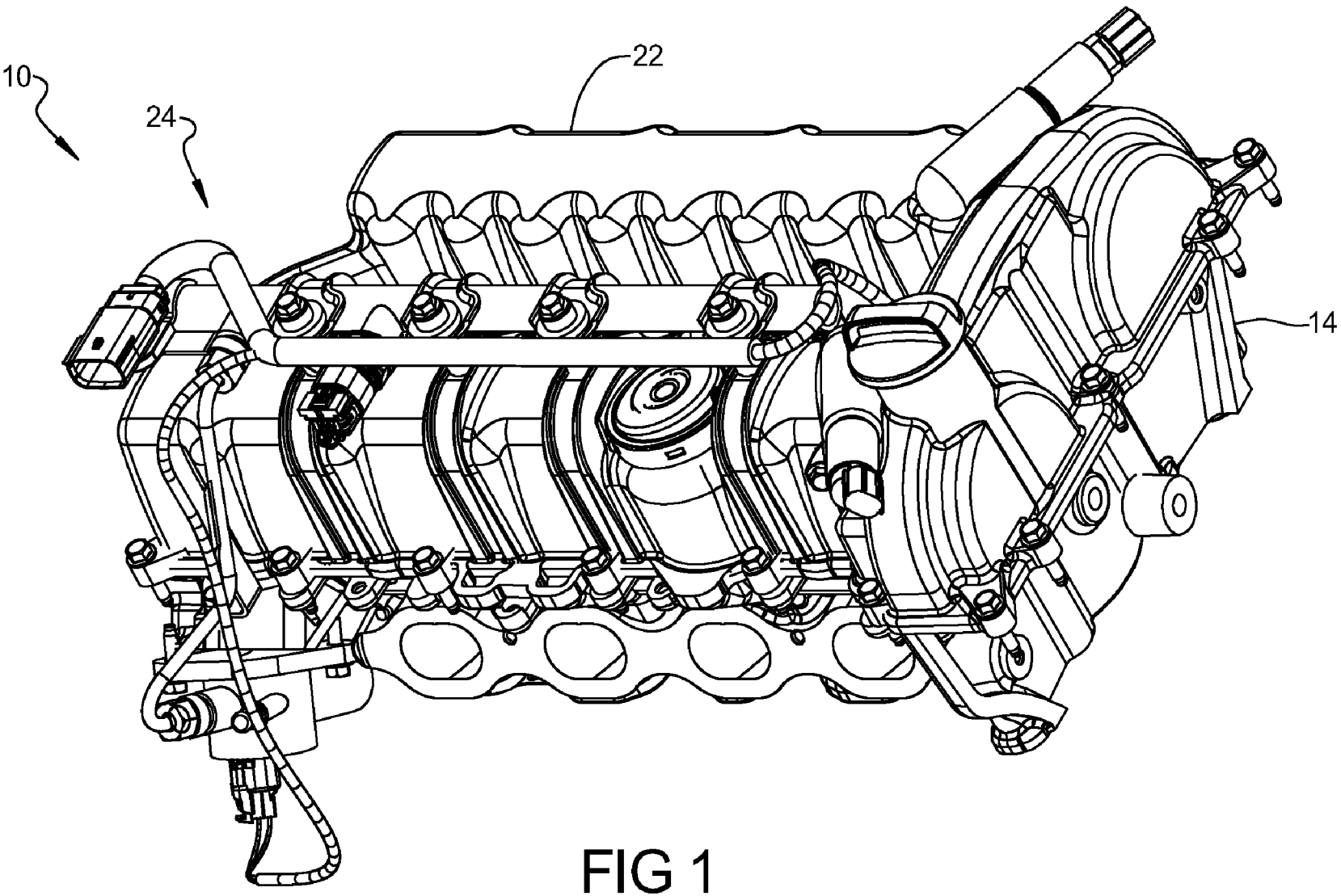
FIG. 1 is a perspective view of a portion of an engine assembly according to the present disclosure.
Figure 3:
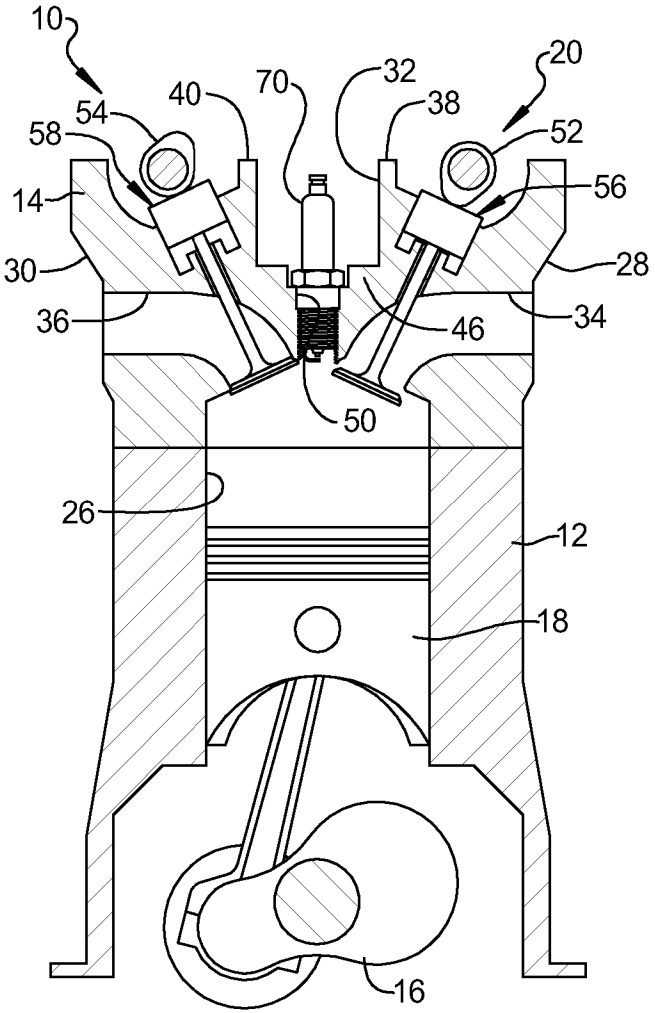
FIG. 3 is an additional schematic fragmentary section view of the engine assembly of FIG. 1.
Figure 2:
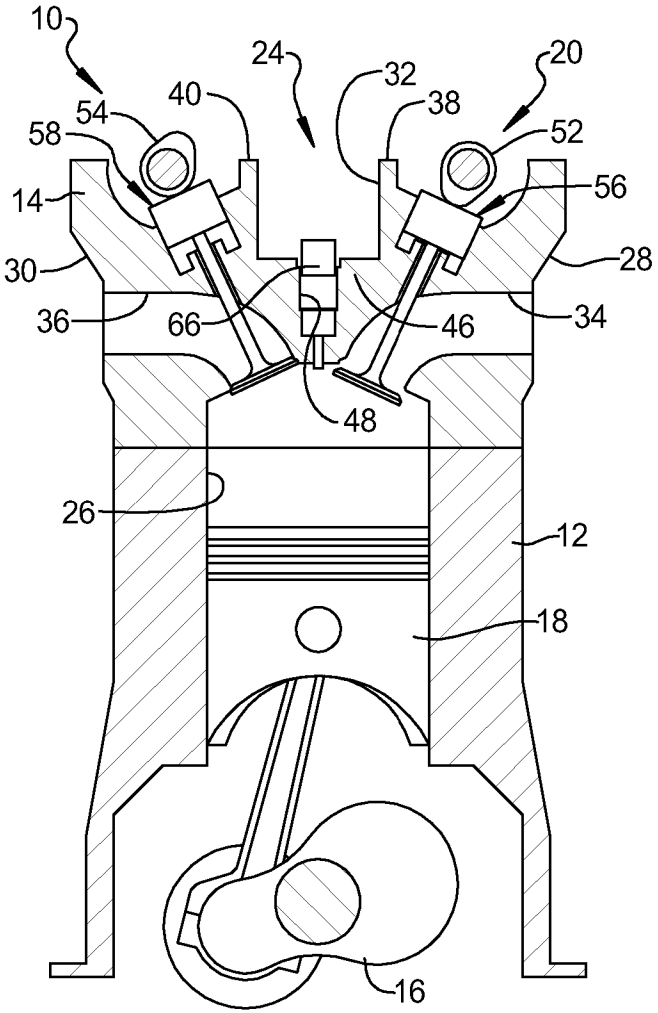
FIG. 2 is a schematic fragmentary section view of the engine assembly of FIG. 1.

As seen in FIGS. 1-3, an engine assembly 10 may include an engine block 12, a cylinder head 14, a crankshaft 16, pistons 18 (one of which is shown), a valvetrain assembly 20, a cam cover 22, and a fuel system 24. The engine block 12 may define cylinder bores 26 (one of which is shown), each having a piston 18 disposed therein. It is understood that the present teachings apply to any number of piston-cylinder arrangements and a variety of engine configurations including, but not limited to, V-engines and inline engines, as well as both overhead cam and cam-in-block configurations.

The cylinder head 14 may be a cast part including an intake region 28 extending longitudinally along the cylinder head 14 on a first lateral end thereof, an exhaust region 30 extending longitudinally along the cylinder head 14 on a second lateral end thereof generally opposite the first lateral end, and a central region 32 extending longitudinally along the cylinder head 14 and located laterally between the intake and exhaust regions 28, 30.

The intake region 28 may include intake ports 34 and the exhaust region 30 may include exhaust ports 36. The central region 32 may form a recessed region defined by first and second longitudinally extending walls 38, 40 and a base 46. The first and second longitudinally extending walls 38, 40 may extend upward from the base 46 and the base 46 may include fuel injector openings 48 (FIG. 2) and spark plug openings 50 (FIG. 3) extending therethrough. The fuel injector openings 48 and spark plug openings 50 may generally be inline with one another along the longitudinal extend of the cylinder head 14. The fuel injector openings 48 and the spark plug openings 50 may be in direct communication with the cylinder bore 26.

The valvetrain assembly 20 may be supported by the cylinder head 14 and may include intake and exhaust camshafts 52, 54 and intake and exhaust valve assemblies 56, 58. The intake camshaft 52 may be rotatably supported on the intake region 28 of the cylinder head 14 and may be engaged with the intake valve assembly 56. The exhaust camshaft 54 may be engaged with the exhaust valve assembly 58.

Figure 5:
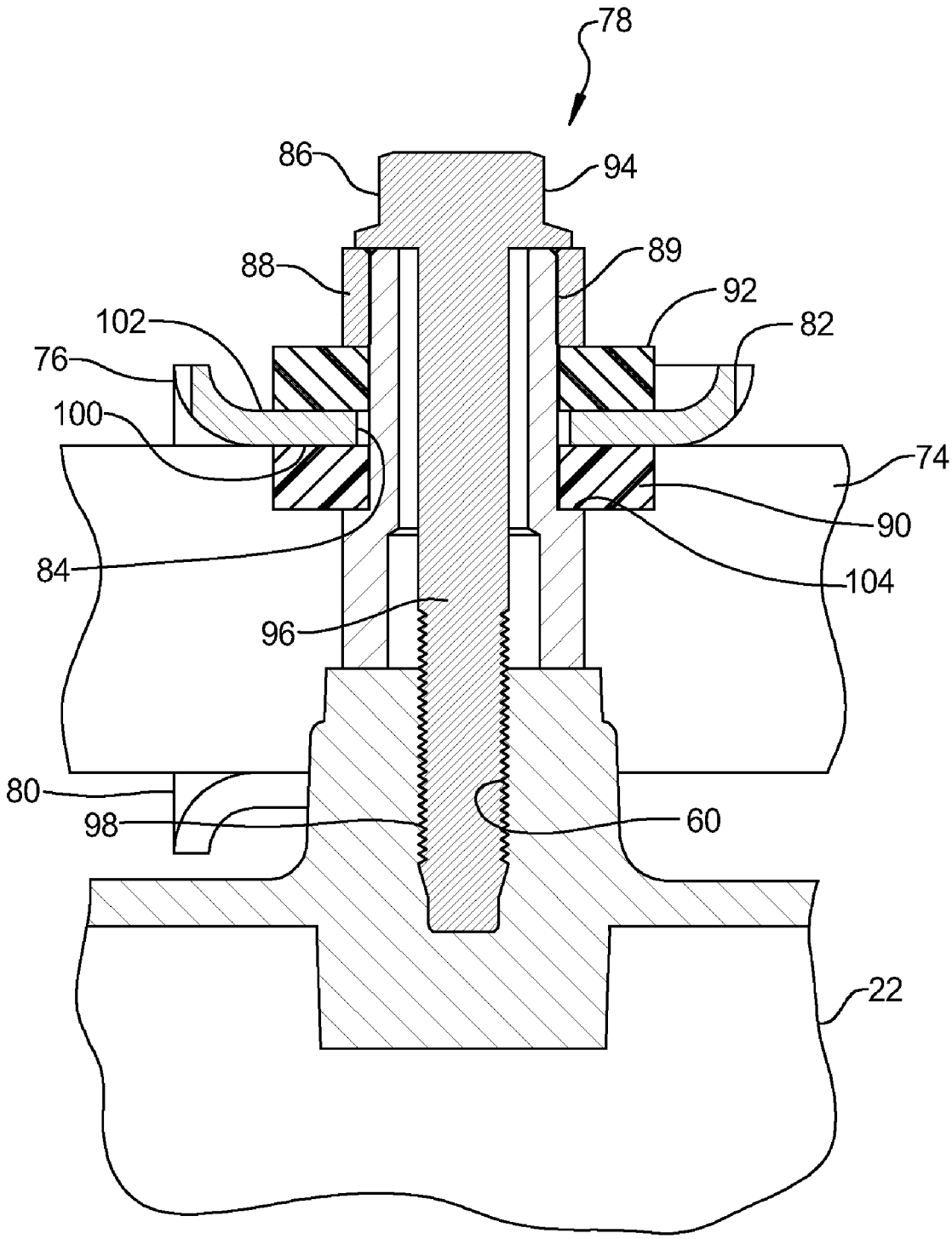
FIG. 5 is a fragmentary section view of the engagement between the fuel rail assembly and the cam cover in the engine assembly shown in FIG. 1.

The cam cover 22 may be fixed to the cylinder head 14. More specifically, the cam cover 22 may be formed from a metal and may be rigidly secured to the cylinder head 14. By way of non-limiting example, the cam cover 22 may be formed from aluminum and may be in direct engagement with the cylinder head (i.e., directly abutting with metal-tometal contact) forming a hard mount arrangement. As seen in FIG. 5, the cam cover 22 may include apertures 60 for mounting the fuel system 24.

Figure 4:
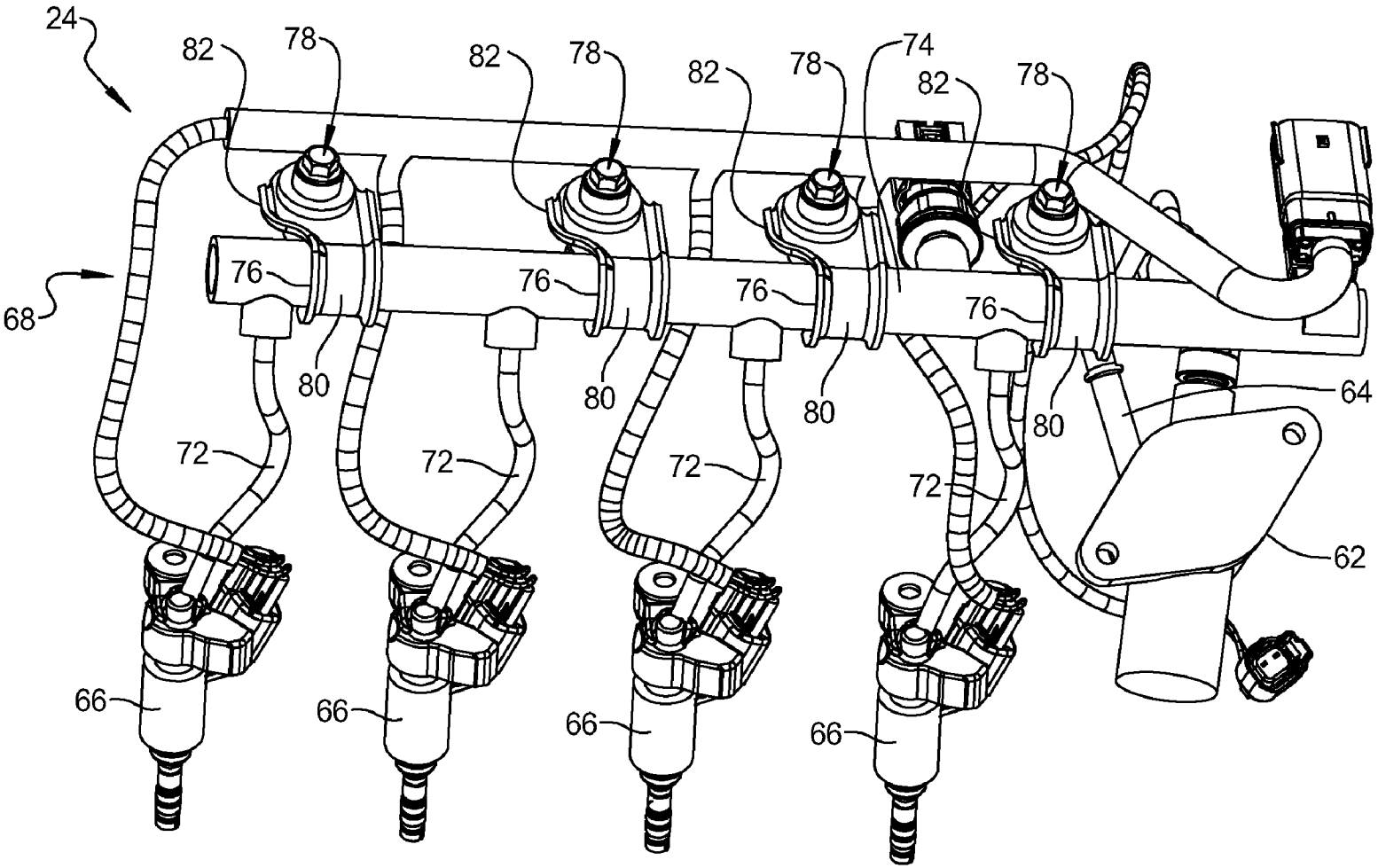
FIG. 4 is a perspective view of the fuel system shown in FIG. 1.

With reference to FIG. 4, the fuel system 24 may include a fuel pump 62, a fuel line 64, fuel injectors 66, and a fuel rail assembly 68. The fuel pump 62 may be in fluid communication with the fuel rail assembly 68 via the fuel line 64. The fuel injectors 66 may be located in the fuel injector openings 48 (FIG. 2) and spark plugs 70 may be located in the spark plug openings 50 (FIG. 3). Therefore, the fuel injectors 66 may be located in the central region 32 of the cylinder head 14 between the intake and exhaust valve assemblies 56, 58, forming a central direct injection configuration. The fuel injectors 66 may be directly coupled to the fuel rail assembly 68 via additional fuel lines 72. As a result, the fuel injectors 66 may be located between the intake and exhaust camshafts 52, 54 and between the outlet of the intake port 34 and the inlet of the exhaust port 36.

The fuel rail assembly 68 may include a fuel rail 74, brackets 76 and a mounting assembly 78. The fuel rail 74 may include a longitudinally extending body located above the central region 32 of the cylinder head 14 between the intake and exhaust regions 28, 30. The brackets 76 may each include a rail engagement portion 80 and a fastener engagement portion 82. The rail engagement portion 80 may extend around an outer circumference of the fuel rail 74 and may be fixed to the fuel rail 74. The fastener engagement portion 82 may extend radially from the rail engagement portion 80 and fuel rail 74 and may define apertures 84.

With additional reference to FIG. 5, the mounting assembly 78 may include fasteners 86, spacers 88, a sleeve 89 and first and second isolation members 90, 92. The fasteners 86 may include a head 94 and a shaft 96 having a threaded region 98 engaged with the aperture 60 in the cam cover 22 to secure the fuel rail 74 to the cam cover 22. By way of non-limiting example, when assembled, the sleeve 89 may extend through the aperture 84 in the bracket 76 and abut the cam cover 22. The fastener 86 may extend through the sleeve 89 and may be in threaded engagement with the aperture 60 in the cam cover 22. The bracket 76 may be located axially along the shaft 96 of the fastener 86 between the head 96 of the fastener 86 and the cam cover 22.

The first isolation member 90 may be located axially between a first side 100 of the bracket 76 and the cam cover 22. More specifically, the first isolation member 90 may abut a stepped region 104 on the sleeve 89 and the first side 100 of the bracket 76. The second isolation member 92 may be located axially between a second side 102 of the bracket 76 and the head 94 of the fastener 86. More specifically, the spacer 88 may be located axially between the head 94 and the second isolation member 92 and the second isolation member 92 may abut the second side 102 of the bracket 76 and the spacer 88. By way of non-limiting example, the first and second isolation members 90, 92 may be formed from an elastomeric material providing damping.

When assembled, the first isolation member 90 may be compressed between the first side 100 of the bracket 76 and the stepped region 104 of the sleeve 89 and the second isolation member 92 may be compressed between the second side 102 of the bracket 76 and the spacer 88, isolating the fuel rail 74 from vibration of the cam cover 22. The head 94 of the fastener 86 may abut the sleeve 89 and the sleeve 89 may abut the cam cover 22, forming an axial stop for the fastener 86. A similar mounting assembly may be used to couple the fuel injectors 66 to the cylinder head 14.

Figure 6:
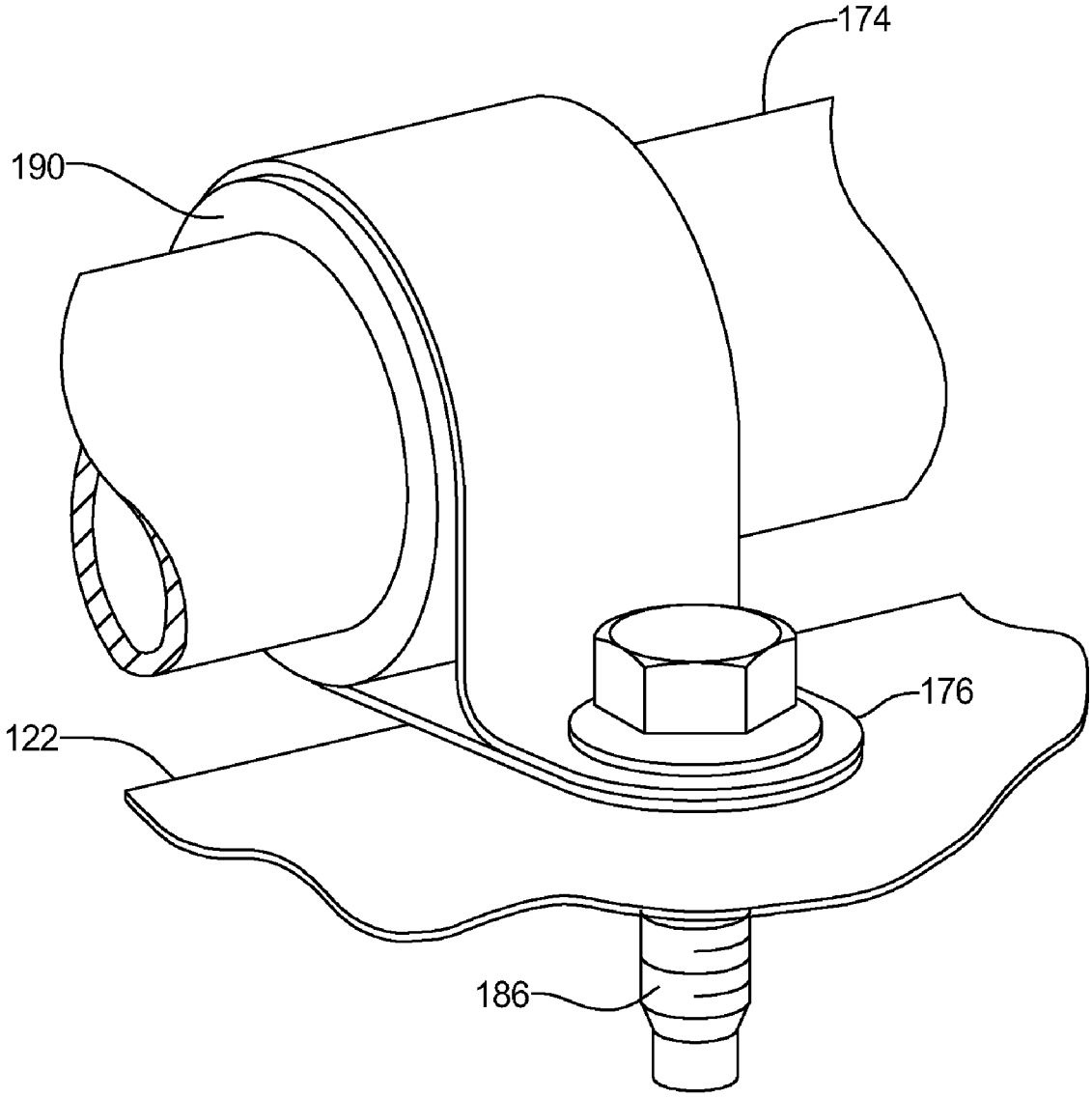
FIG. 6 is a fragmentary perspective view of an alternate fuel rail mounting assembly according to the present disclosure.

In an alternate arrangement shown in FIG. 6, an isolation member 190 may be located between the fuel rail 174 and the cam cover 122, and more specifically radially between the fuel rail 174 and the bracket 176. The isolation member 190 may extend around an outer circumference of the fuel rail 174 and the bracket 176 may extend around an outer circumference of the isolation member 190. The fastener 186 may directly couple the bracket 176 to the cam cover 122. The isolation member 190 may isolate the fuel rail 174 from vibration transmitted to the bracket 176.

What is claimed is:

1. An engine assembly comprising:
a cylinder head defining intake and exhaust ports;
a cam cover fixed to the cylinder head;
a fuel rail assembly including:
a fuel rail; and
a bracket assembly fixed to the fuel rail and including a fastener and an isolation member, the fastener being free from direct engagement with the cylinder head and being engaged with the cam cover and securing the fuel rail thereto with the isolation member located between the fuel rail and the cam cover to isolate vibration therebetween; and
a fuel injector in communication with the fuel rail and extending into a combustion chamber defined by the cylinder head at a location between the intake and exhaust ports.

2. The engine assembly of claim 1, further comprising intake and exhaust camshafts rotationally supported on the cylinder head and having the fuel injector being located therebetween.

3. The engine assembly of claim 2, wherein the fuel rail is located between the intake and exhaust camshafts.

4. The engine assembly of claim 1, wherein the cam cover directly abuts the cylinder head.

5. The engine assembly of claim 4, wherein the cam cover is formed from a metal.

6. The engine assembly of claim 1, wherein the fuel rail assembly includes a fuel feed line extending from the fuel rail to the fuel injector.

7. The engine assembly of claim 1, wherein the bracket assembly includes a bracket secured to the fuel rail, the fastener extending through the bracket and securing the fuel rail to the cam cover.

8. The engine assembly of claim 7, wherein the isolation member is located axially on the fastener between the bracket and the cam cover.

9. The engine assembly of claim 8, wherein the bracket is directly secured to the fuel rail.

10. The engine assembly of claim 7, wherein the isolation member is located between the bracket and the fuel rail.

11. The engine assembly of claim 10, wherein the isolation member extends around an outer circumference of the fuel rail and the bracket extends around an outer circumference of the isolation member.

12. The engine assembly of claim 1, wherein the isolation member is formed from an elastomeric material.

13. An engine assembly comprising:
a cylinder head defining intake and exhaust ports;
a cam cover fixed to the cylinder head and defining a threaded bore offset from the cylinder head;
a fuel rail assembly including:
a fuel rail; and
a bracket assembly including a bracket fixed to the fuel rail, a fastener extending through an aperture in the bracket and in threaded engagement with the threaded bore of the cam cover, and a first isolation member located axially on the fastener between a first side of the bracket and the cam cover to isolate vibration between the cam cover and the fuel rail; and a fuel injector in communication with the fuel rail and extending into a combustion chamber defined by the cylinder head at a location between the intake and exhaust ports.

14. The engine assembly of claim 13, wherein the first isolation member is formed from an elastomeric material.

15. The engine assembly of claim 13, wherein the cam cover directly abuts the cylinder head.

16. The engine assembly of claim 13, wherein the bracket assembly includes a second isolation member located axially between a head of the fastener and a second side of the bracket opposite the first side.

17. The engine assembly of claim 16, wherein the bracket assembly includes a sleeve extending through the aperture in the bracket and abutting the cam cover, the sleeve located radially between the aperture and the fastener and forming an axial stop for the fastener.

18. An engine assembly comprising:

a cylinder head defining intake and exhaust ports;

a cam cover fixed to the cylinder head;

a fuel rail assembly including:

a fuel rail; and a bracket assembly including a first isolation member extending around an outer circumference of the fuel rail, a bracket extending around an outer circumference of the isolation member and fixed to the fuel rail, and a fastener extending through an aperture in the bracket, engaged with the cam cover and free from direct engagement with the cylinder head; and a fuel injector in communication with the fuel rail and extending into a combustion chamber defined by the cylinder head at a location between the intake and exhaust ports.

19. The engine assembly of claim 18, wherein the cam cover directly abuts the cylinder head.

20. The engine assembly of claim 18, wherein the isolation member is formed from an elastomeric material.

* * * * *